United States Patent [19]

Lewis et al.

[11] 4,091,477

[45] May 30, 1978

[54] BASES FOR SHOWERS

[75] Inventors: Robert Lewis; Jack Lewis, both of Birmingham, England

[73] Assignee: Dolphin Showers (Patent) Limited, Worcester, England

[21] Appl. No.: 697,563

[22] Filed: Jun. 18, 1976

[30] Foreign Application Priority Data

Jun. 20, 1975 United Kingdom ..... 26259/75

[51] Int. Cl.[2] ..... A47K 1/00

[52] U.S. Cl. ..... 4/146; 4/168; 4/169; 4/188; 4/DIG. 2

[58] Field of Search ..... 4/146, 169, 188, 167, 4/168, 166, 187 R, DIG. 2, DIG. 13, 145, 155, 156, 151, 147

[56] References Cited

U.S. PATENT DOCUMENTS

| | | | |
|---|---|---|---|
| 877,770 | 1/1908 | Hines et al. | 4/188 |
| 1,289,225 | 12/1918 | Montan | 4/167 |
| 3,457,568 | 7/1969 | Amatruda | 4/146 |
| 3,535,715 | 10/1970 | Booker et al. | 4/167 |

*Primary Examiner*—Richard E. Aegerter
*Assistant Examiner*—L. Footland
*Attorney, Agent, or Firm*—Scrivener, Parker, Scrivener and Clarke

[57] ABSTRACT

A known type of base for a shower comprises a carrier having a shower tray. The carrier can be moved between a first position and a second position. In the first position the shower tray is substantially horizontal and can thus be used in taking a shower. In the second position the shower tray is substantially vertical and the carrier thus occupies less floor space. The improvement characteristic of the invention is the provision of a wash basin as part of the carrier; the basin opens upwards for use in washing when the carrier is in its second position.

4 Claims, 3 Drawing Figures

BASES FOR SHOWERS

This invention relates to bases for showers.

A base for a shower normally comprises a tray formed with a shallow recess in which the user can stand when taking a shower, and is provided with a drainage outlet through which water can escape from the tray to a suitable drain.

As the use of showers is becoming increasingly popular many people wish to instal showers in their houses and other dwellings but have difficulty in finding space for them.

With a view to saving space it has been proposed to provide a base for a shower with a shower tray which is capable of being tipped up when not in use so that it occupies less floor-space than it does when it is in its normal position of use.

The present invention aims to provide an improved arrangement.

According to the present invention there is provided a base for a shower comprising a carrier having a shower tray, the carrier being mounted so as to be capable of movement between a first position in which the tray extends substantially horizontally so that it can be used in taking a shower, and a second position in which the tray extends substantially vertically, the base being characterised in that the carrier also has a wash basic which, when the carrier is in its second position, opens upwards so that it can be used in washing.

With this arrangement the shower base can be fitted in place of an existing hand basin.

In a preferred construction the carrier has separate individual drainage means for the shower tray and the wash basin, these drainage means both discharging into a common drainage outlet which does not move with the carrier.

In an alternative construction the basin has a drainage outlet which leads to a drainage pipe, the drainage outlet of the shower tray leading to the same drainage pipe, the drainage outlets being so positioned that when the base is in its first position the drainage outlet of the wash basin is considerably higher than that of the tray, and is near the level of the top of the tray, and when the base is in its second position the drainage outlet of the shower tray is considerably higher than the drainage outlet of the wash basin. In this way, when the base is in use for the purposes of taking a shower, water draining from the tray does not normally escape through the drainage outlet of the wash basin, and when the base is in use as a wash basin water draining from the basin does not normally escape through the drainage outlet of the shower tray.

Figure 1:
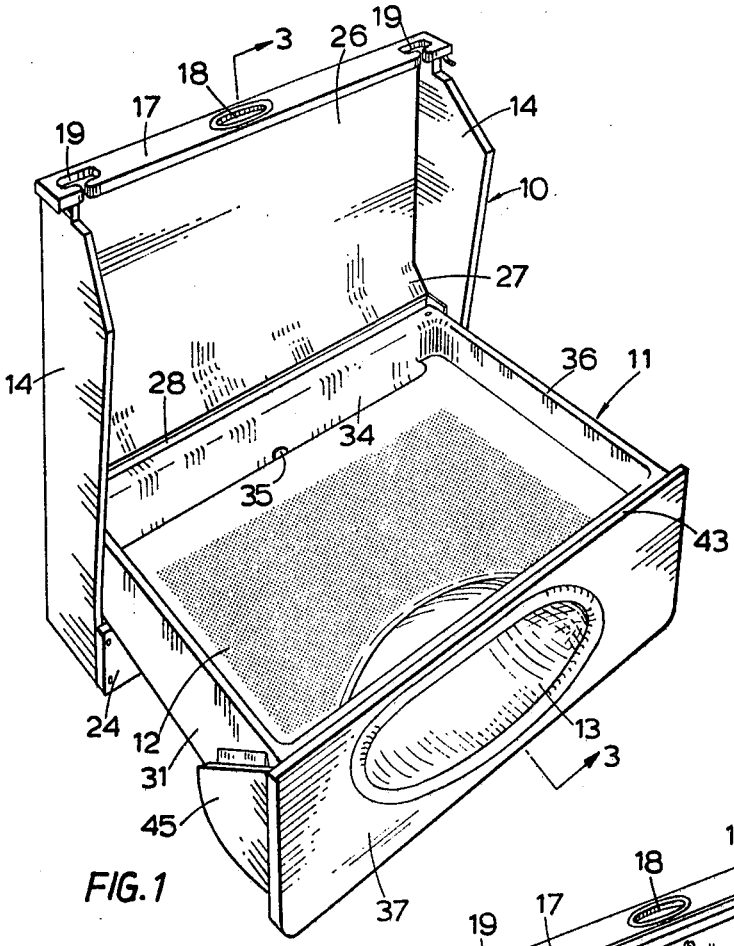
Figure 2:
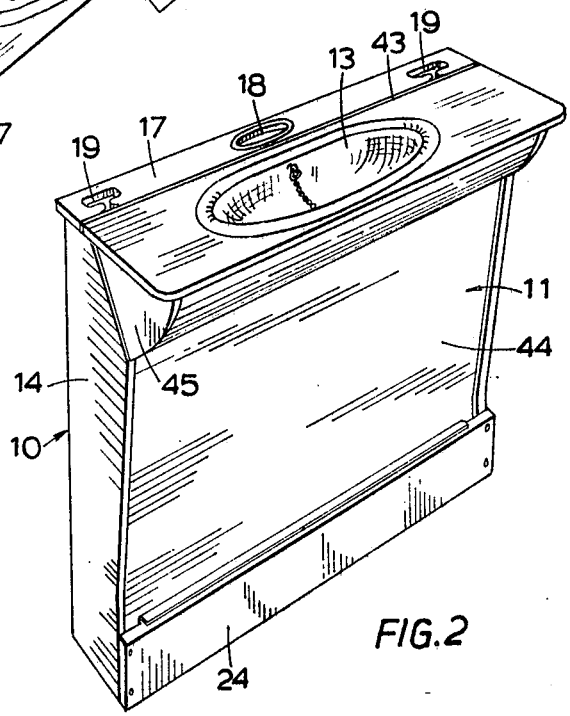
Figure 3:
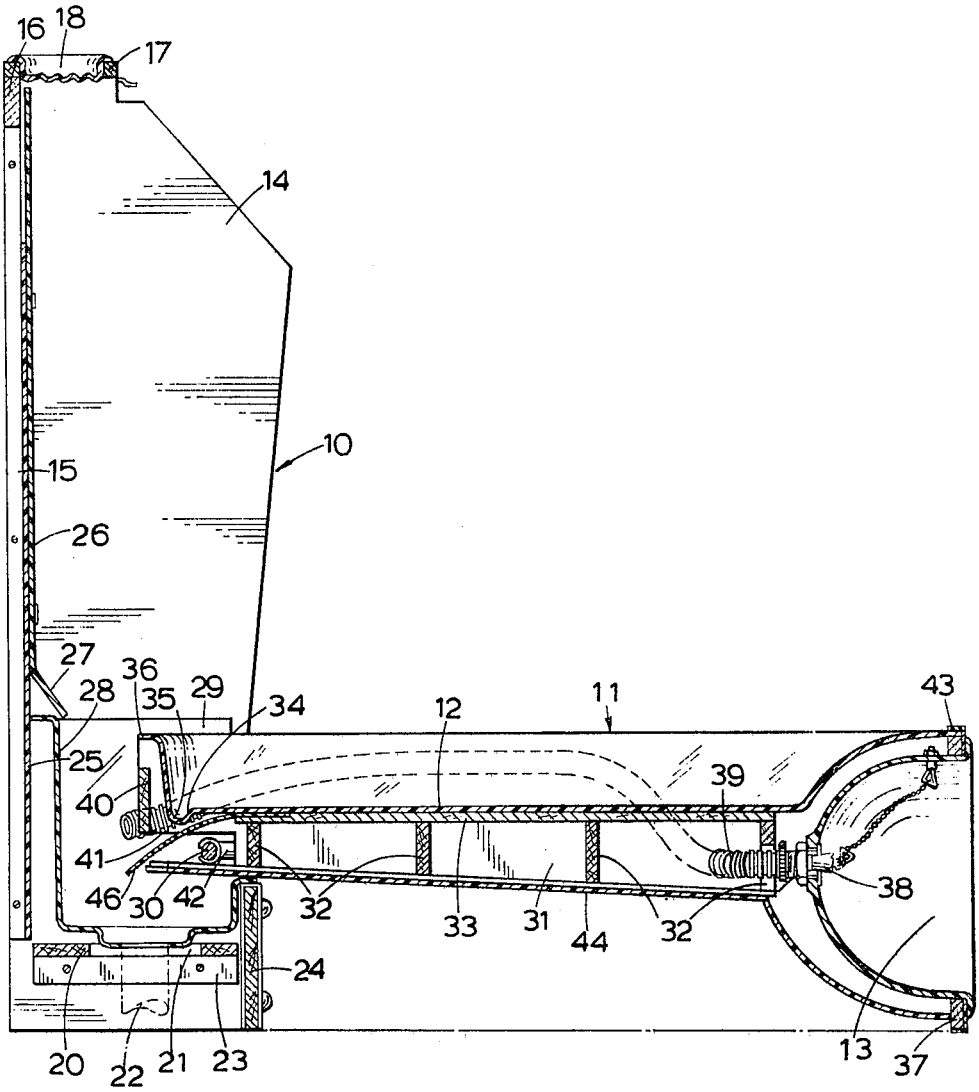

An embodiment of the present invention will now be described in greater detail, by way of example, with reference to the accompanying drawings, in which:

FIG. 1 is a perspective view of a shower base embodying the invention and in its first position, FIG. 2 is a similar perspective view of the shower base shown in FIG. 1, but in its second position, and FIG. 3 is a section, to a rather larger scale, along the line 3—3 of FIG. 1.

Briefly the shower base comprises a stand 10, which is fixed permanently in an upright position against a wall, and a carrier 11 which is movable to and fro as desired between a first position of use as shown in FIG. 1 and a second position of use as shown in FIG. 2. The carrier 11 includes a shower tray 12 formed with a shallow recess. The tray may be made from any suitable material, a glass-reinforced plastics material being preferred. Alternatively the tray may be vacuum-moulded from an acrylic resin. The carrier 11 also includes a wash basin 13 which may be made from the same material as that used for the tray 12. The tray 12 and basin 13 are arranged as shown so that when the carrier is in the first position (FIG. 1) the tray extends in a generally horizontal direction and the user can stand in the tray to take a shower, but when the carrier is in the second position (FIG. 2) the tray extends in a generally vertical position and the wash basin 13 then opens upwards at the top of the base so that the user can use it for washing.

The stand 10 comprises spaced, upright side members 14 shaped in the manner illustrated. The side members are made from plywood faced at least on the inside with a layer of water-proof plastics material. A wooden frame, comprising uprights 15 and a cross-member 16, is fixed between the side members 14 at the rear of the stand. To the top of the side members is secured a horizontal, plywood plate 17 the ends of which projects a little beyond the side members. At its centre the top plate 17 is formed with a hole which receives a soap-dish 18, while near its ends it is formed with T-shaped holes 19 which open at the front. The purpose of these is described below. A plywood support plate 20 extends horizontally between the side members 14 with a little above the lower edges thereof. This plate 20 is formed with a central hole 21 through which a drainage pipe may extend (the pipe being indicated by chain-dotted lines 22). The ends of the plate 20 are secured to support bars 23 on the inside faces of the side members. A plywood kick-board 24 is secured to the lower parts of the front edges of the side members. A relatively thin plywood panel 25 is secured to the front of the uprights 15 but does not extend upwards to the cross-member 16.

A splash-panel 26 made from a rigid plastics sheet material is mounted on the front of the panel 25 and extends downwards from immediately beneath the top plate 17. The lower marginal part 27 of the splash-panel is inclined forwards and downwards and overhangs a flange at the upper rear edge of a trough member 28 which is also formed from a rigid plastics sheet material. The trough member has integral end panels 29 which abut the side members 14. At its centre the base of the trough member is recessed, and a hole in the recess receives the drainage pipe 22.

A metal rail 30 extends between the side members 14 a little above and to the rear of the top edge of the kick-board 24. The carrier 11 is supported on this rail 30 and in moving from one position to the other swings about the axis of the rail.

For convenience of description the carrier will be described as if it is in the first position (FIGS. 1 and 3). The carrier has plywood side members 31 which are somewhat tapered to the rear as best seen in FIG. 3. The side members 31 are interconnected by a plurality of spaced, parallel plywood battens 32. A plywood panel 33 is secured to the upper edges of the battens 32 and provides a support for the recessed portion of the shower tray 12. The central, recessed portion of the tray is substantially flat but may be formed with an array of small projections (shown diagrammatically in FIG. 1) each in the shape of a shallow dome, in order to provide a grip for the user's feet and to allow water to drain from beneath the user's feet. The recessed portion of the tray is substantially horizontal but is preferably inclined to the rear by a few degrees so that water tends to run from it into a transverse groove 34 at the rear. A hole 35 at the centre of the groove enables the water to be discharged from the tray when the shower is in use. A strip 46 of rubber or similar flexible material extends from between the panel 33 and tray 12, beneath the hole 35 and over the rail 30, and hangs down into the trough member 28. The strip thus guides water from the hole 35 into the trough member 28 and prevents it inadvertently entering the hollow interior of the carrier 11. The marginal parts of the tray 12 are curved upwards and terminate in an outwardly directed horizontal flange 36 which overlies and is secured to the side members 31 and the upper edge of a plywood end panel 37 which extends across the forward ends of the side members 31 and projects a little beyond the side members.

A relatively large hole of approximately eliptical shape in the end panel 37 receives the wash basin 13. The basin has a conventional drain hole and plug 38, the drain hole leading to a drainage pipe 39 which is conveniently of the flexible kind, though it does not flex once it has been installed. The pipe 39 extends through the front batten 32, around one side of the tray, and through a transverse bar 40 interconnecting the rear ends of the side members 31. As can be seen in FIGS. 1 and 3 the shape of the front, central part of the tray 12 is modified somewhat to make room for the adjacent part of the basin 13. In use, however, this is found not to cause noticeable inconvenience to the user.

When the carrier is in its first position (FIGS. 1 and 3) the lower edge of the end panel 37 rests on the floor and affords support for the carrier.

The rear end of each side member 31 is cut away as illustrated to form a slot 41. A bearing member 42 formed from a resilient plastics material is secured at the end of each slot and has a C-shaped portion which can be snapped into engagement with the rail 30. As mentioned above the carrier 11 can be swung about the axis of the rail, but in addition the carrier can be separated from the stand 10 and replaced again at will merely by its being pulled away from the rail and pushed back onto it again; this assists maintenance of the shower base.

When the carrier is swung to its second position (FIG. 2) the end panel 37 is aligned with the top plate 17, and the carrier can be retained in the second position by means of releasable catches (not shown) secured to the undersides of the projecting portions of the end panel and top plate. Conveniently the catches are of the kind commonly used to hold down the lid of a suitcase, and comprising a pivoted lever with a finger-piece at its free end and a wire bail pivoted to the lever, the bail co-operating in use with a fixed hook. A strip 43 of resilient foam material (see FIG. 3) forms a seal between the top plate 17 and the end panel 37.

It will be appreciated that when the carrier is in its second position water from the basin passes through the pipe 39 and is discharged into the trough member 28.

To avoid an unsightly appearance, a decorative front panel 44 is provided at the front of the carrier, this extending from a position adjacent to the kick-board 24 to the edge of the end panel 37, the panel being shaped to accommodate the wash basin 13, as shown in FIGS. 2 and 3. Further, wing pieces 45 are secured to the side members 31 and form forward extensions to the upper parts of the side members 14 of the stand when the carrier is in its second position.

The base would normally be used in conjunction with a shower head (not shown) having a rose through which a spray of water can be directed downwards onto a person taking a shower. The shower head may also be used to supply water to the basin when the base in in its second position, and to this end the shower head is preferably movable between a first or upper position it is suitable for directing water onto a person taking a shower and a second or lower position in which it directs water into the basin. The head may be supplied with water through a flexible hose, and the head may be fixed to one end of a short arm, the other end of which is pivotally connected to a slider. The slider can be moved up and down a rod mounted in an upright position a little in front of the wall, the ends of the rod being held by brackets secured to the wall. The lower end of the rod is a little above the level of the base when the base is in its second position. The arm pivots about a horizontal axis relative to the slider, and the slider can rotate on the rod so that the head can direct water in a range of directions from a range of heights. Free pivotal movement of the arm is prevented by friction, and similarly, frictional forces acting between the slider and the rod cause the slider to remain in any position of adjustment to which it is moved.

Water may be supplied to the shower head from a water heater of the kind that is the subject of British Pat. No. 1,253,849 of Dolphin Showers Limited, the heater being mounted on the wall above the base and being provided on its front surface with a mirror, the height of which is such as to enable a person of normal height to look at the reflection of his or her face with standing on the floor.

Shower curtains are preferably provided for use when the user is taking a shower. The curtains may hang from a rail projecting outwards from the wall and such as to enable the curtains to close the sides and front of the shower when in use. The curtains can be drawn to positions adjacent to the wall when the shower is not in use. The curtains can then be tucked into the T-shaped holes 19 in the top plate 17 so that when the carrier 11 is then moved to its second position (FIG. 2) the lower parts of the curtains are retained within the shower base and, if wet, can drip into the trough member 28.

We claim:

1. A base for a shower comprising a carrier, a shower tray forming part of the carrier, the carrier being movable between a first position in which the tray extends substantially horizontally so that it can be used in taking a shower, and a second position in which it extends substantially vertically, the base being characterized in that it includes a wash basin also forming part of the carrier and which opens upwards for use in washing when the carrier is in its second position, said carrier having separate individual drainage means both discharging into a common drainage outlet which does not move with the carrier.

2. A base for a shower according to claim 1 wherein said base includes an end panel which is substantially vertical when said carrier is in its first position and substantially horizontal when the carrier is in its second position, said end panel having a hole there through in which said wash basin is received.

3. A base for a shower comprising a carrier, a shower tray forming part of the carrier, the carrier being movable between a first position in which the tray extends substantially horizontally so that it can be used in taking a shower, and a second position in which it extends substantially vertically, the base being characterized in that it includes a wash basin also forming part of the carrier and which opens upwards for use in washing when the carrier is in its second position, said carrier having separate individual drainage means for the shower tray and the wash basin, said drainage means both discharging into a common drainage outlet which does not move with the carrier, said base including a fixed stand to which the carrier is pivotally connected, the stand having a drainage trough into which the tray can drain when the carrier is in its second position.

4. A base for a shower according to claim 3 which also includes a fixed stand to which the carrier is pivotally connected, wherein said carrier is readily detachable from said stand.

* * * * *